US006055962A

United States Patent [19]

Kirk

[11] Patent Number: 6,055,962

[45] Date of Patent: May 2, 2000

[54] FUEL SYSTEM FOR AN INTERNAL COMBUSTION ENGINE

[75] Inventor: J. David Kirk, Fond du Lac, Wis.

[73] Assignee: Brunswick Corporation, Lake Forest, Ill.

[21] Appl. No.: 09/190,431

[22] Filed: Nov. 12, 1998

[51] Int. Cl.[7] ..... F02M 37/04

[52] U.S. Cl. ..... 123/516; 123/533

[58] Field of Search ..... 123/531, 533, 123/510–511, 516, 73 AF, 73 CC, DIG. 5

[56] References Cited

U.S. PATENT DOCUMENTS

| | | | |
|---|---|---|---|
| 3,957,025 | 5/1976 | Heath | 123/136 |
| 4,142,494 | 3/1979 | Negri et al. | 123/119 |
| 4,241,711 | 12/1980 | Detweiler | 123/559 |
| 4,386,593 | 6/1983 | Tibbs | 123/523 |
| 4,635,606 | 1/1987 | Koike et al. | 123/463 |
| 4,878,475 | 11/1989 | Birsa | 123/525 |
| 5,119,790 | 6/1992 | Olson | 123/516 |
| 5,137,002 | 8/1992 | Mahoney et al. | 123/516 |
| 5,216,996 | 6/1993 | Kato | 123/533 |
| 5,368,001 | 11/1994 | Roche | 123/516 |
| 5,375,578 | 12/1994 | Kato et al. | 123/516 |
| 5,389,245 | 2/1995 | Jaeger et al. | 123/516 |
| 5,579,740 | 12/1996 | Cotton et al. | 123/516 |
| 5,598,827 | 2/1997 | Kato | 123/533 |
| 5,785,015 | 7/1998 | Philippe et al. | 123/70 |

*Primary Examiner*—Thomas N. Moulis
*Attorney, Agent, or Firm*—William D. Lanyi

[57] ABSTRACT

A fuel system uses a vacuum source to draw fuel from a fuel tank into a fuel reservoir. By avoiding the need for a fuel tank to pump fuel from the fuel tank to the fuel reservoir, a common incidence of vapor lock is prevented. The vacuum is provided by a crankcase of a compressor.

19 Claims, 4 Drawing Sheets

FUEL SYSTEM FOR AN INTERNAL COMBUSTION ENGINE

BACKGROUND OF THE INVENTION

1. Field of the Invention

The present invention is generally related to a fuel system for an internal combustion engine and, more particularly to a fuel injection system for an engine of an outboard motor in which a compressor crankcase is used to draw a vacuum which causes fuel to flow from a fuel tank to a fuel reservoir, such as a fuel vapor separator.

2. Description of the Prior Art

Many different types of fuel systems are well known to those skilled in the art of internal combustion engine design. Most fuel systems for internal combustion engines employ carburetion or fuel injection to provide fuel to a combustion chamber of the engine. In certain types of engines, such as fuel injected engines, a fuel vapor separator is used to separate liquid fuel from fuel vapor. In addition, in certain types of fuel injected engines, air compressors are used to provide a supply of pressurized air to assist in the injection of fuel into the combustion chambers of the engine.

U.S. Pat. No. 5,785,015, which issued to Phillippe et al on Jul. 28, 1998, discloses an internal combustion engine that is provided with a system for direct fuel injection with pneumatic assistance. The engine comprises a single piston compressor associated to each of the combustion chambers of the engine. The compressor draws an air/fuel mixture and, due to the action of its discharge stokes, injects the mixture directly inside the combustion chamber at an instant which is appropriately determined by the synchronization of the compressor. The discharge valve of the compressor is arranged inside the combustion chamber.

U.S. Pat. No. 4,241,711, which issued to Detweiler on Dec. 30, 1980, describes a fuel control system for a turbo charged engine. The system provides fuel delivered to the carburetor under the control of a vacuum operated device which is under the further control of a device which senses pressures upstream and downstream of the turbo charged compressor. It delivers a vacuum signal to the fuel control device in proportion to the manifold pressure even though the latter pressure may be a positive pressure.

U.S. Pat. No. 5,046,474, which issued to Percy on Sep. 10, 1991, described a crankcase ventilation and evacuation system. Crankcase fumes are treated by the apparatus which envisions a primary filtering system for extracting fuel, moisture and solids from the engine crankcase. The solids are mainly trapped by a filter element preventing reentry into the engine. The fuel vapors and moisture are conducted returnably to the engine for increasing horsepower and a secondary filtering system for secondarily for filtering the fuel vapors from solids before passage to the engine is also provided.

U.S. Pat. No. 4,142,494, which issued to Negri et al on Mar. 6, 1979, describes a turbo charged engine with a vacuum valve. The engine has a carburetor fuel metering control rod, an ignition timing control member, and exhaust gas recirculation control pintle, and an induction air temperature damper that is operated in response to vacuum signals created by the pressure in the induction passage between the throttle and the turbocharger compressor and a valve which bleeds the vacuum signals to atmospheric pressure when the compressor discharge pressure rises above a selected value to establish a rich air-fuel mixture, retard ignition timing, inhibit exhaust gas recirculation and provide a cool induction air flow for maximum power operation.

U.S. Pat. No. 4,878,475, which issued to Birsa on Nov. 7, 1989, discloses a fuel supply system for internal combustion engines. The fuel supply system is intended for use with internal combustion engines in which two different fuels are used, one to start the engine, to operate it at idling speed and to supplement the other fuel during acceleration, and the second to operate the engine at its normal working speed. The first fuel may be propane for starting, idling and for an acceleration supplement. The second fuel for normal working speeds, or normal driving speed may be gasoline. A first vacuum control valve assembly delivers the first fuel such as propane from a pressurized supply tank to the carburetor below the conventional butterfly valve of the throttle control to start the engine and operate it at idle speed. A second vacuum controlled valve assembly delivers the first fuel, such as propane, to the carburetor above the butterfly valve only when the accelerator opens the throttle and its butterfly valve to initiate acceleration, and only during acceleration. The second fuel such as gasoline which is used for the normal working or driving operation is supplied to the engine in the usual manner, from its supply tank to the carburetor by a fuel pump, and from the carburetor through the intake manifold to the combustion chamber by the vacuum created as the engine operates.

U.S. Pat. No. 4,635,606, which issued to Koike et al on Jan. 13, 1987, describes a fuel supply control system for internal combustion engines, capable of preventing vapor lock. The fuel supply control system for an internal combustion engine has fuel injection valves for supplying the engine with fuel and has its pressure regulated to a predetermined value. A temperature sensor detects a temperature value representative of the temperature of fuel being supplied to the fuel injection valves. When the temperature value detected by the sensor is higher than a predetermined value at the start of the engine, an electronic control unit causes a solenoid-operated selector valve to operate to increase the pressure of fuel being supplied to the engine over a period of time dependent on the temperature value detected by the sensor from the time the engine is started.

U.S. Pat. No. 4,386,593, which issued to Tibbs on Jun. 7, 1983, discloses a fuel-air air injection control system for internal combustion engines. The system is provided for internal combustion engines using gasoline as a fuel. The system includes a vacuum pump which is connected to an airtight fuel supply tank containing a liquid gasoline such that operation of the vacuum pump causes a portion of the liquid gasoline to become continuously vaporized. The vaporized but unheated gasoline is passed through a filter where unwanted contaminants are removed and the fuel is delivered to the intake ducts of the internal combustion engine. Heated air is also supplied to these intake ducts and the vaporized gasoline combines with heated combustion air therein for subsequent ignition in the combustion chambers. The flow of heated combustion air is controlled by the operator to control the speed of the engine.

U.S. Pat. No. 3,957,025, which issued to Heath et al on May 18, 1976, describes a method and apparatus for controlling displaced vapor emissions in motor vehicles. The vacuum emission control system is adapted to accommodate displaced vapors generated during the filling a motor vehicle storage tank, wherein a first storage tank is adapted to communicate sequentially with an intermediate vacuum accumulator and ultimately with the intake manifold of an internal combustion engine. In the preferred embodiment, a dispensing nozzle is inserted into vapor sealing engagement with a first liquid storage tank wherein the storage tank is equipped with a unidirectional self venting gas cap. Upon insertion of the dispensing nozzle a unidirectional bypass line normally closed is opened via an entry port flap actuator. A regulating negative pressure head draws the displaced liquid fuel tank vapors sequentially through a bypass valve, a first pressure regulator, a unidirectional check valve, a vacuum accumulator holding tank, a second unidirectional check valve which is also a flow regulator, a second pressure regulator, and finally into the intake manifold vacuum source of an internal combustion engine. An alternative embodiment is described wherein the liquid storage tank is vented directly to the atmosphere via conventional two way vent. In this embodiment, upon insertion of the dispensing nozzle, the entry port flap actuator closes the vent line which is normally open and simultaneously opens the normally closed unidirectional displaced vapor line to the vacuum accumulator.

One problem that occurs in certain types of internal combustion engines is an occasional inability to pump fuel, either from a fuel tank to a fuel reservoir or from the fuel reservoir to the combustion chambers of the engine. This problem can be seriously exacerbated in fuel injected engines which recirculate portions of the fuel from the injectors back to the fuel reservoir. This continued recirculation of bypass fuel raises the temperature of the fuel and increases the likelihood that the fuel will reach a temperature at which it will vaporize within the fuel delivery system. If the fuel vaporizes to a gaseous or vaporous state, certain types of pumps are unable to pump the fuel vapor. This condition is commonly referred to as vapor lock and usually occurs when the pump is insufficiently primed with liquid fuel because of the presence of fuel vapor. This problem can also occur within the pump which is used to draw fuel from a fuel storage tank and pump fuel to a fuel reservoir.

When the internal combustion engine is used in an outboard motor application, the bypass flow of fuel, which flows to the fuel injectors and is returned to the fuel reservoir without being injected into the combustion chambers, is not returned to the main fuel tank. Instead, because of safety concerns, the fuel is recirculated back to the fuel reservoir which is generally a fuel vapor separator. Under certain conditions, such as low speed operation, the majority of the fuel which is pumped to the fuel injectors is returned to the fuel vapor separator and this continuous recirculation by the pump raises the temperature of the fuel. The increased temperature of the fuel, particularly under warm ambient conditions, increases the likelihood that vapor lock can occur within the pump which pumps the fuel from the fuel vapor separator to the fuel injection system.

In outboard motor applications, the pump which draws fuel from the primary fuel tank and pumps it to the fuel vapor separator can also experience vapor lock. This is caused when the liquid fuel in the fuel line between the fuel tank and the fuel vapor separator is vaporized as a result of increased temperatures. The fuel in the fuel line can also be vaporized as a result of the reduced pressure at the inlet of a fuel pump as it attempts to pump the fuel from the primary fuel tank to the fuel vapor separator or other type of fuel reservoir. Therefore, vapor in the fuel system of an internal combustion engine can be caused by several conditions and can occur at several locations within the fuel system.

If vapor lock occurs in the fuel pump which draws fuel from the primary fuel tank and pumps it to the fuel vapor separator, the liquid level in the fuel vapor separator may be significantly lower because of the lack of additional liquid fuel pumped into the fuel vapor separator and also because of the fact that the high pressure fuel pump will continue to draw the liquid fuel from the fuel vapor separator and pump it to the fuel injection system. If the liquid fuel within the fuel vapor separator is drawn down to a sufficiently low level or if the fuel is of a sufficiently high temperature, the inlet of the high pressure pump can experience vapor lock and the fuel injection system will be deprived of fuel for the engine.

In view of the above described potential problems relating to a fuel injected engine, it would be significantly beneficial if a fuel system could be provided which does not require a pump to pump fuel from the primary fuel tank to the fuel vapor separator. It would be further beneficial if the fuel can be drawn from the primary fuel tank and conducted to the fuel vapor separator regardless of the fuel's temperature and regardless of the amount of fuel vapor in the fuel line with the liquid fuel.

SUMMARY OF THE INVENTION

A fuel system for an internal combustion engine made in accordance with the present invention comprises a vacuum source. The vacuum can be a crankcase region of a compressor. The fuel system further comprises a fuel reservoir which is connected in fluid communication with a combustion chamber of the engine in order to supply a fuel to the combustion chamber for ignition. The fuel reservoir is shaped to contain the fuel in both liquid and gaseous states with the gaseous, or vaporous, state existing in an ullage of the fuel reservoir. The vacuum source is connected in fluid communication with the ullage of the fuel reservoir. In addition, the fuel system comprises a fuel tank which is connected in fluid communication with the fuel reservoir in order to supply liquid fuel from the fuel tank to the fuel reservoir.

In a particularly preferred embodiment of the present invention the vacuum source is a crankcase region of a compressor which incorporates a reciprocating piston. In certain embodiments of the present invention, a pump is provided which has an inlet connected in fluid communication with the fuel reservoir and an outlet connected in fluid communication with the combustion chamber in order to supply fuel from the fuel reservoir to the combustion chamber. It should be understood that one type of fuel reservoir can be a fuel vapor separator as used in certain fuel systems for fuel injected engines.

The present invention can further comprise a fuel injection system which is connected in fluid communication between the pump and the combustion chamber with a fuel inlet of the fuel injection system being connected in fluid communication with the outlet of the pump. The fuel injection system is connected to the compressor in order to receive a pressurized gas from the compressor.

A fuel outlet of the fuel injection system can be connected to the fuel reservoir in order to provide a bypass conduit for the fuel past the fuel injection system. In other words, as fuel is provided by the pump to the fuel injection system, some of the fuel is not passed through the injectors into the combustion chambers of the engine. That fuel, which is not used, is conducted back to the fuel reservoir to be pumped again by the pump toward the fuel injection system. In other words, some of the fuel provided by the pump is continually recirculated back to the fuel reservoir so that the pump can recirculate it back toward the fuel injection system.

Certain embodiments of the present invention can comprise a heat exchanger connected in fluid communication with the fuel injection system and with the fuel reservoir in order to cool the fuel as it flows from the fuel injection system to the fuel reservoir.

The engine of the present invention can be a propulsion system for an outboard motor and the engine can be a fuel injected engine.

BRIEF DESCRIPTION OF THE DRAWINGS

The present invention will be more fully and completely understood from a reading of the description of the preferred embodiment in conjunction with the drawings in which.

DESCRIPTION OF THE PREFERRED EMBODIMENT

Figure 1:
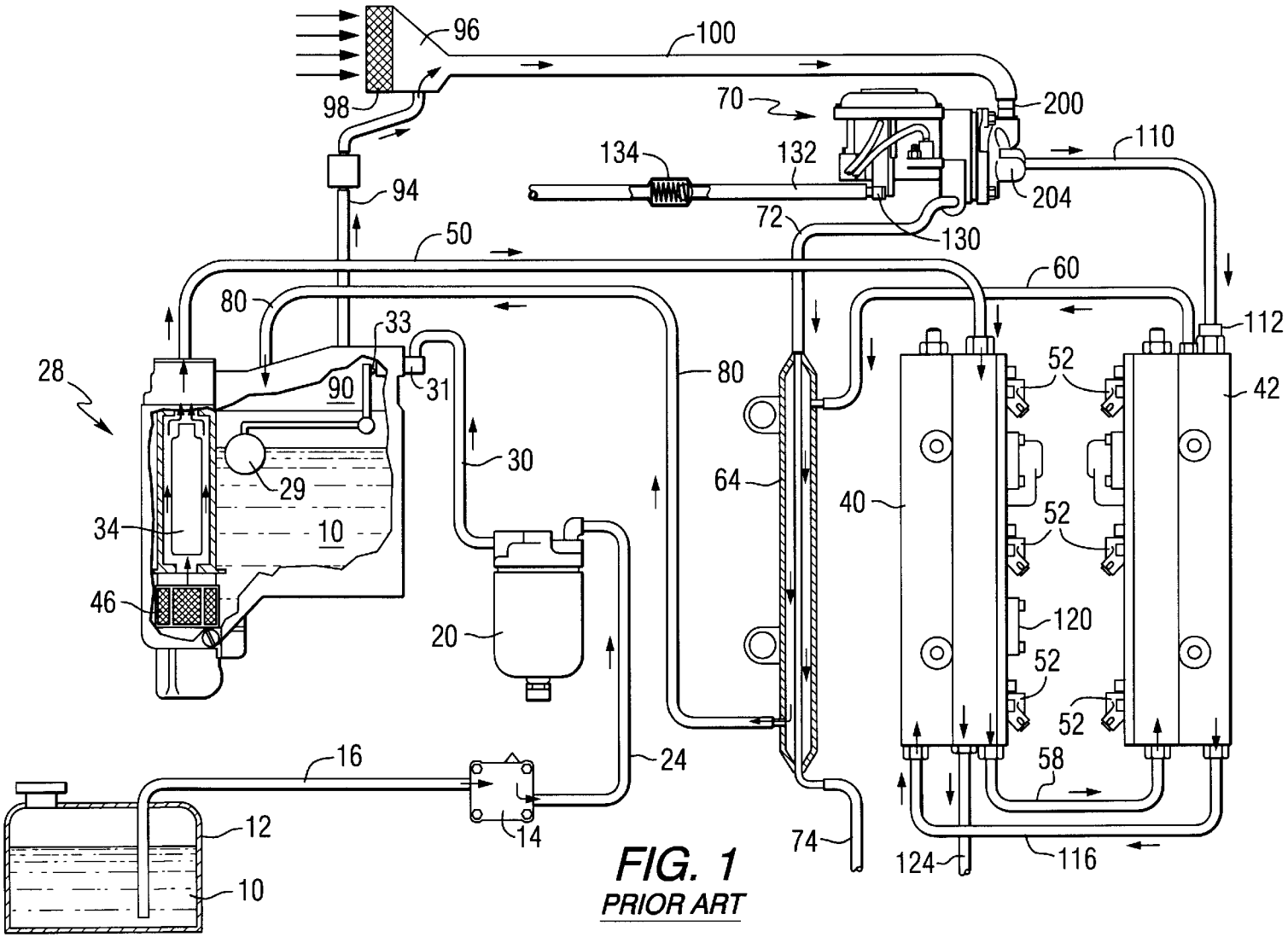
FIG. 1 PRIOR ART
FIG. 1 illustrates a fuel system that is generally known to those skilled in that art.

Throughout the description of the preferred embodiment, like components will be identified by like reference numerals.

FIG. 1 represents a typical fuel system for a fuel injected engine. Fuel 10 is drawn from a fuel tank 12 through line 16 by a mechanical fuel pump 14. The fuel 10 is pumped, by fuel pump 14, to a water separating filter 20, through line 24. The fuel, after passing through the filter 20, is conducted to a fuel reservoir such as the fuel vapor separator 28. After the fuel 10 enters the fuel reservoir of the fuel vapor separator 28, through line 30, it is pumped by high pressure fuel pump 46 from the fuel reservoir to the fuel injection rails 40 and 42. The high pressure pump 46, which is driven by motor 34, receives fuel at its inlet and then provides the fuel, through line 50, to a first fuel rail 40.

The fuel, at a pressure of approximately 90 psi, passes through line 50 to the first fuel rail 40 and then, through line 58, a portion of the fuel continues to the second fuel rail 42. Some of the fuel is injected, by the fuel injectors 52, into combustion chambers of cylinders within an internal combustion engine. For purposes of clarity, the cylinders of the engine are not shown in FIG. 1. However, those skilled in the art are well aware of the various types of configurations that can be provided to utilize fuel injectors 52 within cylinders of an internal combustion engine. Although some of the fuel in the fuel rails, 40 and 42, are injected by the fuel injectors 52 into the combustion chambers of the cylinders, a significant portion of the fuel bypasses the fuel injectors 52 and flows through line 60 to the heat exchanger 64. In the heat exchanger 64, the fuel is passed in thermal communication with cooling water that flows from a compressor 70, through line 72. The cooling water, after passing through the heat exchanger 64, flows through line 74. The fuel that enters the heat exchanger 64 through line 60 is returned to the fuel reservoir 28 through line 80.

With continued reference to FIG. 1, it can be seen that some of the fuel is recirculated through a fluid path comprising the high pressure pump 46, line 50, the fuel rails, 40 and 42, line 60, the heat exchanger 64, line 80, and the fuel reservoir of the fuel vapor separator 28. By being continually pumped by the gerotor pump, or high pressure pump 46, this recirculating fuel which bypasses the fuel injectors 52 can be significantly heated. That is why a heat exchanger 64 is provided in an attempt to maintain a desired temperature for the fuel.

Within the fuel vapor separator 28, the fuel can be in two physical states, liquid fuel 10 and fuel vapor 90 in the ullage of the fuel reservoir. The ullage of the fuel reservoir is vented, by line 94, to the air intake 96 of the compressor. Typically, a filter 98 is provided to filter air as it is received at the air intake of the compressor. The fuel vapor 90 is passed into the air intake 96 to be eventually burned by the engine.

An air compressor 70 is provided to take the incoming air, from line 100, and raise the pressure of the air so that it can be used by the fuel injectors 52. This high pressure air is conducted from the air compressor 70 to the fuel rails, 40 and 42, by line 110. The high pressure air, which can vary from approximately 90 psi to approximately 140 psi, passes through an orifice 112 which tends to smooth the undulating pressure pulses and provide air that is approximately 80 psi to the fuel injectors 52. The air also passes from the second fuel rail 42 to the first fuel rail 40 through line 116. The pressure of the air is regulated to approximately 80 psi by a regulator 120. Excess air is vented from the fuel rails through line 124.

In a typical application of a fuel system for a fuel injected engine, the compressor 70 is provided with an outlet 130 which vents its crankcase region through line 132 and check valve 134. This venting is provided so that accumulating oil in the crankcase can be removed from the compressor 70. It should be understood that the compressor 70 is typically lubricated by continually providing a supply of oil to the moving components within the compressor 70. This oil is then collected in the crankcase and removed through line 132. It should also be understood that the pressure within line 132 is undulating in response to the reciprocating movement of a piston within the compressor 70. The pressure in line 132 is generally the same as the pressure within the crankcase of the compressor 70. When the pressure in line 132 is greater than atmospheric pressure, the check valve 134 is moved to an open position and the air can pass, from right to left in FIG. 1, away from the compressor. This air and oil mixture is thereby removed from the compressor.

Figure 2:
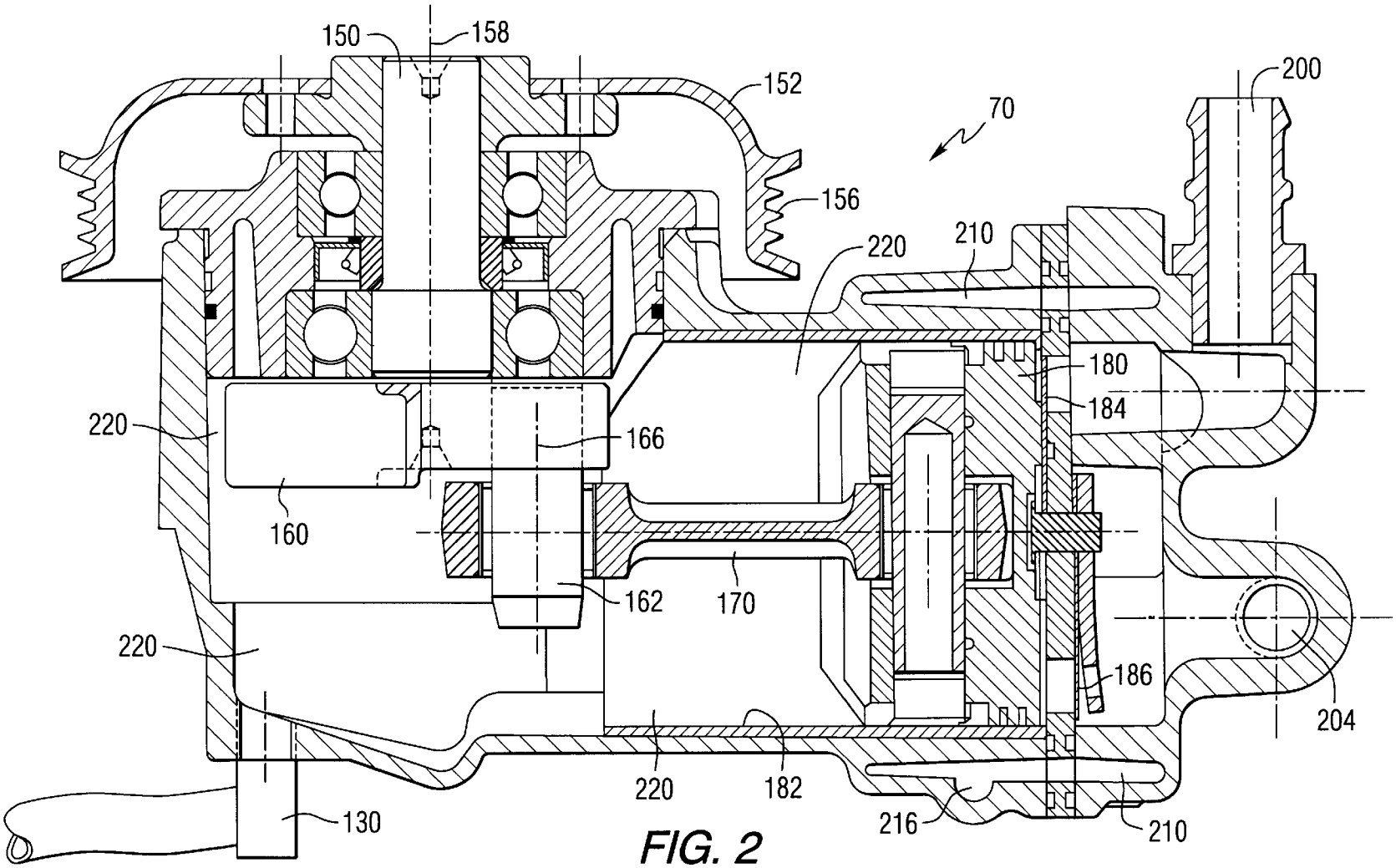
FIG. 2 PRIOR ART
FIG. 2 is a cross section of a compressor.

FIG. 2 shows a cross section view of a compressor 70. A shaft 150 is driven by an attached wheel 152 which, in turn, is driven by a belt (not shown in FIG. 2) which is placed around the wheel 152 at a region identified by reference numeral 156. Rotation of the shaft 150, about centerline 158, causes rotation of the linkage 160 about centerline 158. This, rotates shaft 162 which has a centerline 166 which is offset from centerline 158. Connecting rod 170 is connected to shaft 162 and the movement of centerline 166 around centerline 158 causes a piston 180 to move in a reciprocating motion within cylinder 182. In a manner that is well known to those skilled in the art, a reciprocating piston 180 cooperates with reed valves, 184 and 186, to draw air through the inlet 200 and pressurize the air which flows away from the compressor 70 through air outlet 204. With reference to FIGS. 1 and 2, air inlet 200 is connected to line 100 and air outlet 204 is connected to line 110 in FIG. 1.

A water jacket 210 surrounds the region where the piston 180 compressors the air to reduce the temperature of the compressor 70 in that region. Cooling water is provided to the water jacket 210 and the cooling water flows away from the compressor 70 at the location identified by reference numeral 216 in FIG. 2. This water then flows through line 72 in FIG. 1 to cool the fuel in the heat exchanger 64.

Figure 3:
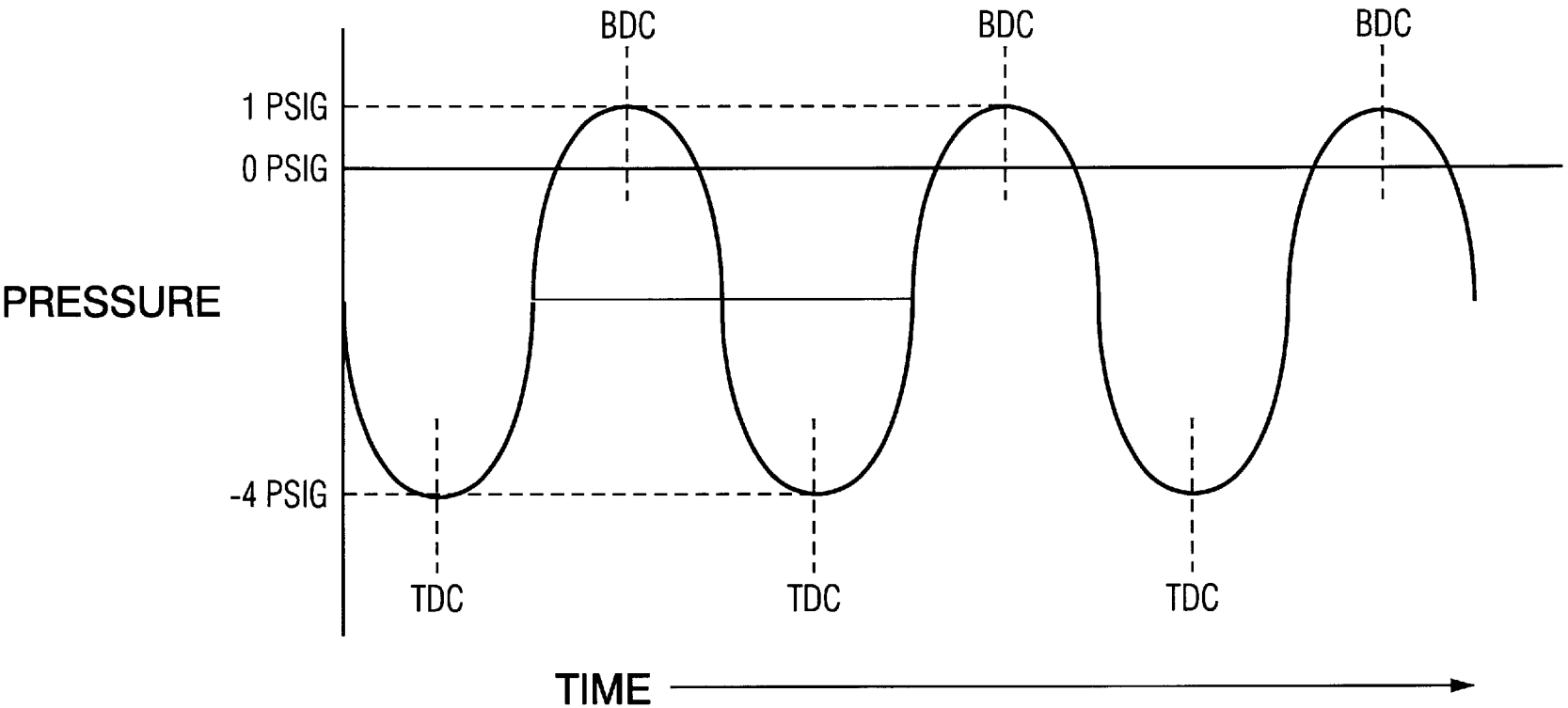
FIG. 3 is a graphical representation of the relationship of the pressure within a crankcase of the compressor to the movement of the piston within the compressor.

The crankcase 220 of the compressor 70 occupies the space below the piston 180 which is identified by reference numerals 220 in FIG. 2. With reference to FIGS. 2 and 3, the pressure of the air within the crankcase 220 is affected by the reciprocating movement of the piston 180. As the piston 180 reciprocates within the cylinder 182 to pressurize the air flowing through the inlet 200 and expel the pressurized air throughout outlet 204, its reciprocating movement also changes the pressure in the crankcase 220 according to an undulating magnitude. That undulating pressure of the air in the crankcase 220 is represented graphically in FIG. 3. When the piston 180 is at its leftmost position in FIG. 2, or at its bottom dead center (BDC) position of its cycle, the pressure in the crankcase 220 is raised because the effective volume of the crankcase 220 is reduced by the piston's movement. This raises the pressure in the crankcase 220 to approximately 1 psig as shown in FIG. 3. When the piston 180 reaches its rightmost position in FIG. 2, or its top dead center (TDC) position within cylinder 182, the volume of the crankcase 220 is increased and the pressure in the crankcase is reduced to approximately −4 psig. With reference to FIG. 1, the pressure represented in FIG. 3 exists within the crankcase 220 and line 132. When the pressure reaches its maximum of approximately 1 psig as the piston 180 reaches its bottom dead center (BDC) position, air is expelled from the crankcase 220 through line 132 and check valve 134. This expulsion of air removes oil from the crankcase 220 through line 132 and check valve 134. As the piston 180 reaches its top dead center (TDC) position, the pressure in the crankcase 220 drops to approximately −4 psig and closes the check valve 134. The pressure in line 132 then drops below atmospheric pressure in response to the decrease in pressure within the crankcase 220.

Figure 4:
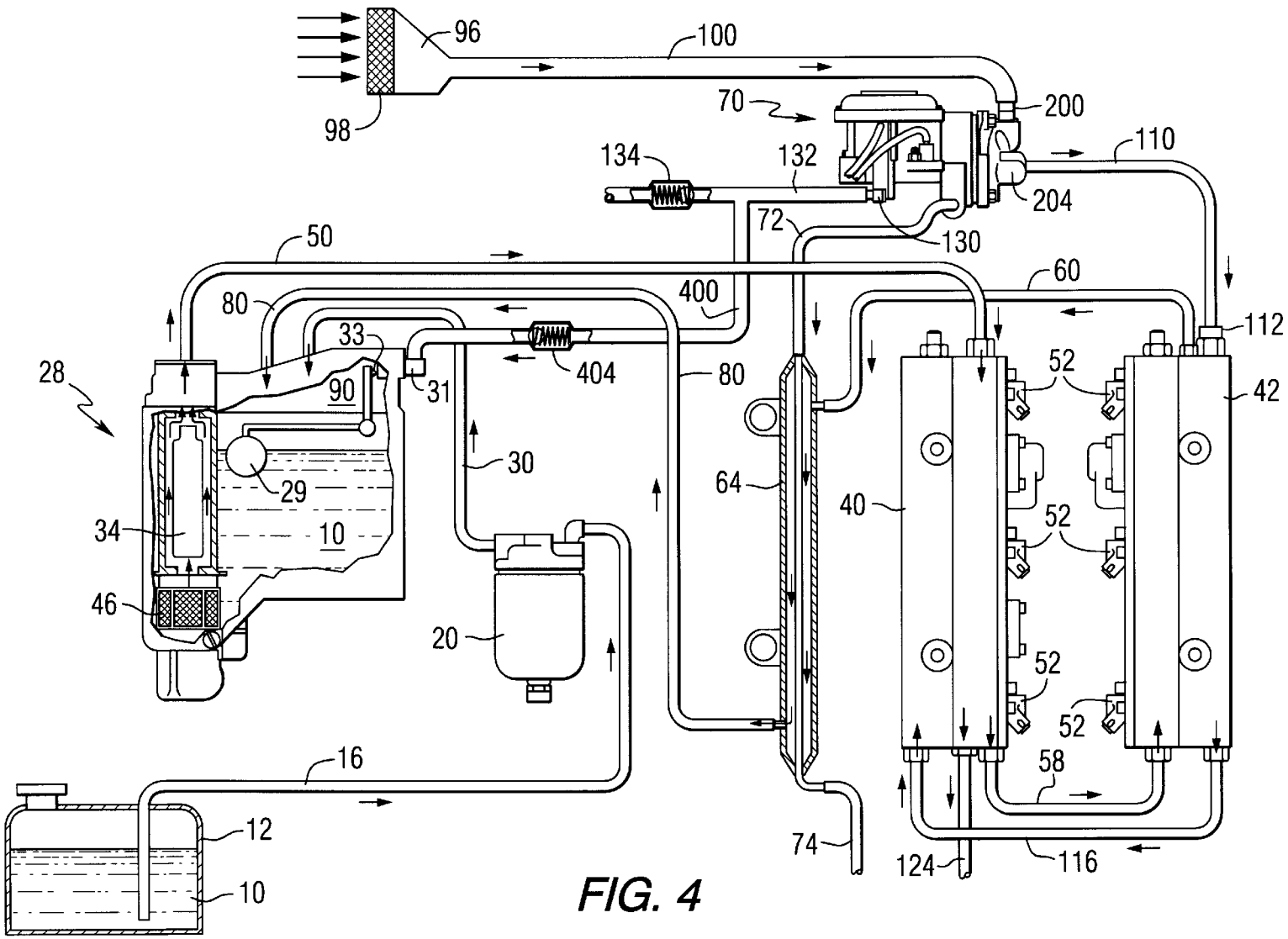
FIG. 4 shows a preferred embodiment of the present invention.

A preferred embodiment of the present invention is illustrated in FIG. 4. The fuel system of FIG. 4 is generally similar to the fuel system of FIG. 1, but with certain modifications which improve its operation and its ability to avoid vapor lock. By comparing FIGS. 1 and 4, it can be seen that the fuel pump 14 is not used in a fuel system made in accordance with the present invention. Instead, a vacuum line 400 is connected in fluid communication with line 132 of the compressor 70. This places line 400 in fluid communication with the crankcase 220 of the compressor 70. Line 400 is also connected with fluid communication with the ullage of the fuel reservoir, which is the fuel vapor separator 28 in FIG. 4. Between line 132 and the fuel reservoir, a check valve 404 is provided.

Line 30 in FIG. 4 is now connected in direct communication with the ullage of the fuel reservoir rather than through valve 31 as shown in FIG. 1. Fuel 10 is drawn from tank 12 by the vacuum created in the ullage of the fuel reservoir by the connection of the vacuum line 400 with the ullage.

With reference to FIGS. 1 and 4, both systems use a valve to control the passage of liquid fuel into the fuel reservoir. In FIG. 1, a float valve 29 responds to the level of the liquid fuel 10 and operates a needle valve 33 to block valve 31 and stop the flow of fuel through line 30 in response to the action of fuel pump 14. In FIG. 4, the float valve 29 also responds to the level of liquid fuel 10, but instead of the needle valve 33 blocking fuel flowing through line 30, as in FIG. 1, it blocks the flow of the fuel vapor 90 through valve 31 and check valve 404 into vacuum line 400. In other words, while the float valve 29 in FIG. 1 operates to stop the flow of liquid fuel into the fuel reservoir, the float valve 29 in FIG. 4 operates to limit the vacuum within the ullage of the fuel reservoir when liquid fuel 10 is at its proper level in the fuel reservoir.

In FIG. 4, the existence of a vacuum within the fuel reservoir draws fuel through line 30, the water separating fuel filter 20, and line 16 from the fuel tank 12. The pressure in line 400 responds in a manner generally similar to that represented in FIG. 3 and the check valve 404 allows air and fuel vapor 90 to flow from the ullage of the fuel reservoir, through the check valve 404, and vacuum line 400. This action maintains a continuous vacuum in the ullage of the fuel reservoir. This vacuum, in turn, draws both fuel vapor and liquid fuel through lines 30 and 16 to provide a supply of fuel to the fuel reservoir as long as the pressure in the ullage is less than atmospheric pressure above the surface of fuel 10 in the fuel tank 12.

The primary advantage of the fuel system shown in FIG. 4 is that a pump 14 is not needed to convey fuel 10 from the fuel tank 12 to the fuel reservoir 28. Instead, the vacuum in the ullage of the fuel reservoir, or fuel vapor separator 28, raises the fuel through lines 16 and 30 and provides a flow of fuel from the fuel tank 12 to the fuel reservoir. Without the need of the fuel pump 14, the possibility of vapor lock in fuel pump 14 is eliminated. The reduced pressure in the ullage of the fuel reservoir draws both fuel vapor and liquid fuel through lines 16 and 30. Even if the liquid fuel 10 is boiling as a result of increased temperatures, no vapor lock can exist between the fuel tank 12 and the fuel reservoir, or fuel separator 28. Since no vapor lock can occur between the fuel tank 12 and the fuel vapor separator 28, a constant level of liquid fuel 10 is maintained within the fuel reservoir. This constant amount of liquid fuel 10 serves to maintain an adequate liquid level above the gerotor pump 46, which is the high pressure fuel pump for the system. In turn, this liquid level in the fuel vapor separator 28 will serve to significantly reduce the temperature of the fuel in the fuel reservoir and thereby reduce the likelihood of vapor lock with regard to fuel pump 46.

With reference to FIGS. 1 and 4, it should also be noted that line 94 no longer connects the ullage of the fuel vapor separator 28 with the air intake 96 of the compressor. Instead, the fuel reservoir is sealed to maintain a vacuum in the ullage above the liquid fuel 10.

In summary, the present invention provides a vacuum source which is connected in fluid communication with the fuel reservoir to maintain the ullage of the fuel reservoir at a pressure below that above the surface of the fuel 10 in fuel tank 12. This eliminates the need for a pump to draw fuel from the fuel tank 12 to the fuel reservoir and thereby reduces a significant possibility of vapor lock under certain adverse conditions. The vacuum source for the present invention illustrated in the preferred embodiment of FIG. 4 is the crankcase of a compressor 70.

Although the present invention has been described with particular detail and illustrated with specificity to enable a preferred embodiment of the present invention to be described in detail, it should be understood that alternative embodiments of the present invention are also within its scope. For example, alternative sources of vacuum can be used instead of a compressor crankcase. In addition, the fuel reservoir need not be a fuel vapor separator. Also, the present invention can be used in conjunction with internal combustion engines which are not fuel injected.

I claim:

1. A fuel system for an internal combustion engine, comprising:

a vacuum source;

a fuel reservoir connected in fluid communication with a combustion chamber of said engine to supply a fuel to said combustion chamber, said fuel reservoir being shaped to contain said fuel in both liquid and vapor states with said vapor state existing in an ullage of said fuel reservoir, said vacuum source being connected in fluid communication with said ullage of said fuel reservoir; and a fuel tank connected in fluid communication with said fuel reservoir to supply said liquid fuel from said fuel tank to said fuel reservoir, said vacuum source being a crank case of a compressor.

2. The fuel system of claim 1, further comprising:

a pump having an inlet connected in fluid communication with said fuel reservoir and an outlet connected in fluid communication with said combustion chamber to supply said fuel from said fuel reservoir to said combustion chamber.

3. The fuel system of claim 2, further comprising:

a fuel injection system connected in fluid communication between said pump and said combustion chamber with a fuel inlet of said fuel injection system being connected in fluid communication with said outlet of said pump, said fuel injection system being connected to said compressor to receive a pressurized gas from said compressor.

4. The fuel system of claim 3, wherein:

a fuel outlet of said fuel injection system is connected to said fuel reservoir to provide a bypass conduit for said fuel past said fuel injection system.

5. The fuel system of claim 4, further comprising:

a heat exchanger connected in fluid communication with said fuel injection system and said fuel reservoir to cool said fuel as it flows from said fuel injection system to said fuel reservoir.

6. The fuel system of claim 1, wherein:

said fuel reservoir is a fuel vapor separator.

7. The fuel system of claim 1, wherein:

said compressor has a reciprocating piston disposed therein.

8. The fuel system of claim 1, wherein:

said engine is a propulsion system for an outboard motor.

9. The fuel system of claim 1, wherein:

said engine is a fuel injected engine.

10. A fuel system for an internal combustion engine of an outboard motor, comprising:

a compressor;

a fuel reservoir connected in fluid communication with a combustion chamber of said engine to supply a fuel to said combustion chamber, said fuel reservoir being shaped to contain said fuel in both liquid and vapor states with said vapor state existing in an ullage of said fuel reservoir, a crankcase of said compressor being connected in fluid communication with said ullage of said fuel reservoir; and a fuel tank connected in fluid communication with said fuel reservoir to supply said liquid fuel from said fuel tank to said fuel reservoir.

11. The fuel system of claim 10, further comprising:

a pump having an inlet connected in fluid communication with said fuel reservoir and an outlet connected in fluid communication with said combustion chamber to supply said fuel from said fuel reservoir to said combustion chamber.

12. The fuel system of claim 11, further comprising:

a fuel injection system connected in fluid communication between said pump and said combustion chamber with a fuel inlet of said fuel injection system being connected in fluid communication with said outlet of said pump, said fuel injection system being connected to said compressor to receive a pressurized gas from said compressor, a fuel outlet of said fuel injection system being connected to said fuel reservoir to provide a bypass conduit for said fuel past said fuel injection system.

13. The fuel system of claim 12, further comprising:

a heat exchanger connected in fluid communication with said fuel injection system and said fuel reservoir to cool said fuel as it flows from said fuel injection system to said fuel reservoir.

14. The fuel system of claim 10, wherein:

said fuel reservoir is a fuel vapor separator.

15. The fuel system of claim 10, wherein:

said engine is a fuel injected engine.

16. A fuel system for a fuel injected internal combustion engine of an outboard motor, comprising:

a compressor;

a fuel reservoir connected in fluid communication with a combustion chamber of said engine to supply a fuel to said combustion chamber, said fuel reservoir being shaped to contain said fuel in both liquid and vapor states with said vapor state existing in an ullage of said fuel reservoir, a crankcase of said compressor being connected in fluid communication with said ullage of said fuel reservoir, said fuel reservoir being a fuel vapor separator; and a fuel tank connected in fluid communication with said fuel reservoir to supply said liquid fuel from said fuel tank to said fuel reservoir.

17. The fuel system of claim 16, further comprising:

a pump having an inlet connected in fluid communication with said fuel reservoir and an outlet connected in fluid communication with said combustion chamber to supply said fuel from said fuel reservoir to said combustion chamber.

18. The fuel system of claim 17, further comprising:

a fuel injection system connected in fluid communication between said pump and said combustion chamber with a fuel inlet of said fuel injection system being connected in fluid communication with said outlet of said pump, said fuel injection system being connected to said compressor to receive a pressurized gas from said compressor, a fuel outlet of said fuel injection system being connected to said fuel reservoir to provide a bypass conduit for said fuel past said fuel injection system.

19. The fuel system of claim 18, further comprising:

a heat exchanger connected in fluid communication with said fuel injection system and said fuel reservoir to cool said fuel as it flows from said fuel injection system to said fuel reservoir.

* * * * *